United States Patent [19]

de Nora et al.

[11] 4,187,155

[45] * Feb. 5, 1980

[54] MOLTEN SALT ELECTROLYSIS

[75] Inventors: Vittorio de Nora, Nassau, The Bahamas; Placido M. Spaziante; Antonio Nidola, both of Milan, Italy

[73] Assignee: Diamond Shamrock Technologies S.A., Geneva, Switzerland

[ * ] Notice: The portion of the term of this patent subsequent to Mar. 27, 1996, has been disclaimed.

[21] Appl. No.: 940,277

[22] Filed: Sep. 7, 1978

Related U.S. Application Data

[63] Continuation of Ser. No. 774,102, Mar. 7, 1977, Pat. No. 4,146,438, which is a continuation-in-part of Ser. No. 672,279, Mar. 31, 1976, abandoned, which is a continuation-in-part of Ser. No. 673,460, Apr. 5, 1976, abandoned, which is a continuation-in-part of Ser. No. 681,279, Apr. 28, 1976, abandoned, which is a continuation-in-part of Ser. No. 686,943, May 17, 1976, abandoned.

[51] Int. Cl.[2] ..... C25B 11/04; C25C 3/06

[52] U.S. Cl. ..... 204/67; 204/243 R; 204/290 R; 204/29 P

[58] Field of Search ..... 204/67, 290 R, 291, 204/243 R

[56] References Cited

U.S. PATENT DOCUMENTS

| | | | |
|---|---|---|---|
| 3,691,052 | 9/1972 | Langley | 204/290 F |
| 4,060,476 | 11/1977 | Treptow et al. | 204/291 |
| 4,065,377 | 12/1977 | Zollner et al. | 204/290 F |
| 4,097,415 | 6/1978 | Moulin et al. | 204/290 F |

FOREIGN PATENT DOCUMENTS

| | | | |
|---|---|---|---|
| 1164477 | 6/1969 | United Kingdom | 204/290 F |

*Primary Examiner*—Howard S. Williams
*Attorney, Agent, or Firm*—Hammond & Littell

[57] ABSTRACT

A novel method of molten salt electrolysis and novel electrolytic cells for molten salt electrolysis wherein the anodes for the electrolysis are comprised of a self-sustaining matrix of sintered powders of at least one oxy-compound such as oxides, multipleoxides, mixed oxides, oxyhalides and oxycarbides, of at least one metal selected from the group consisting of lanthanum, terbium, erbium, ytterbium, thorium, titanium, zirconium, hafnium, niobium, chromium and tantalum and at least one electroconductive agent, the said anode being provided over at least a portion of its surface with at least one electrocatalyst for the electrolysis reaction and bipolar electrodes for the said cells which electrodes are resistant to corrosion in molten salt electrolysis and have good electroconductive and good electrocatalytic activity.

25 Claims, 1 Drawing Figure

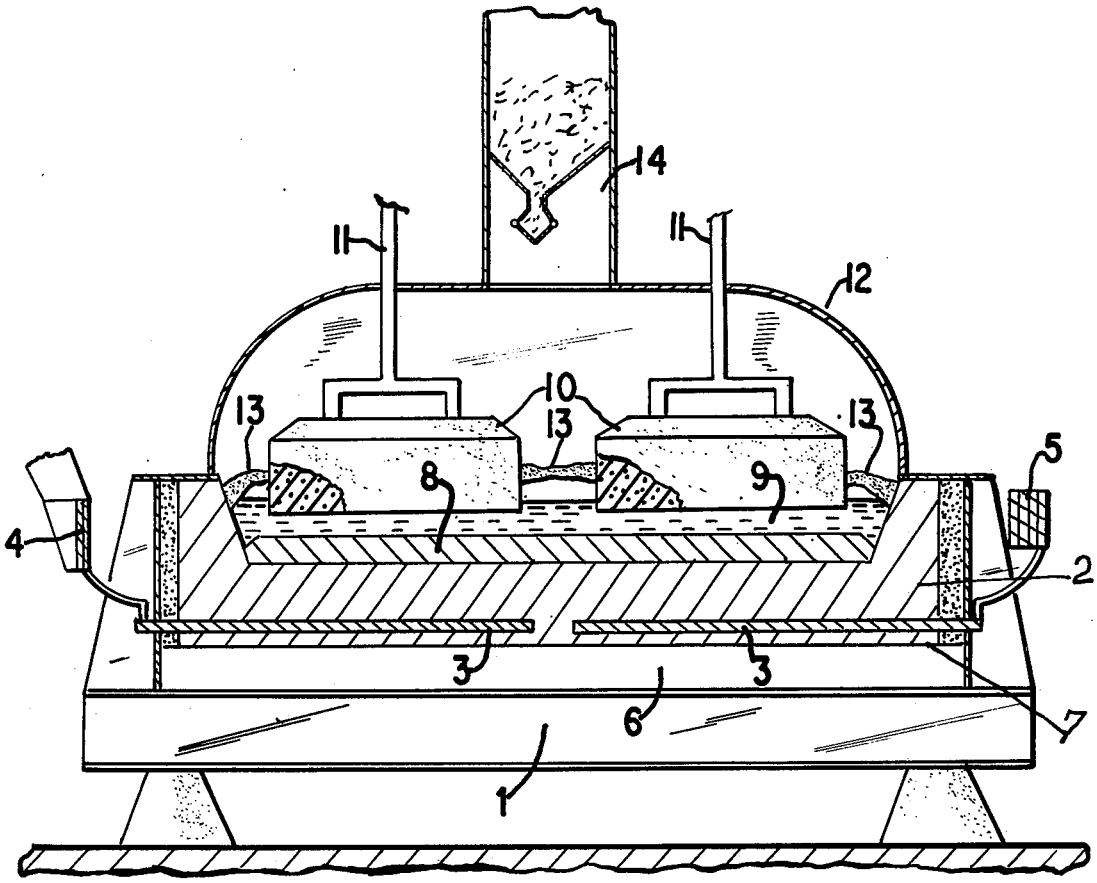
14
11
11
12
10
13
13
13
5
8
9
4
2
3
3
6
7
1

MOLTEN SALT ELECTROLYSIS

PRIOR APPLICATIONS

This application is a continuation of our copending application Ser. No. 774,102 filed Mar. 7, 1977, now U.S. Pat. No. 4,146,438, which in turn is a continuation-in-part of our copending, commonly assigned application Ser. No. 672,279 filed Mar. 31, 1976; and a continuation-in-part of Ser. No. 673,460 filed Apr. 5, 1976, and a continuation-in-part of No. 681,279 filed Apr. 28, 1976; and a continuation-in-part of Ser. No. 686,943 filed May 17, 1976, all abandoned.

STATE OF THE ART

Dimensionally stable electrodes for anodic and cathodic reactions in electrolysis cells have recently become of general use in the electrochemical industry replacing the consumable electrodes of carbon, graphite and lead alloys. They are particularly useful in flowing mercury cathode cells and in diaphragm cells for the production of chlorine and caustic, in metal electrowinning cells wherein pure metal is recovered from aqueous chloride or sulfate solution as well as for the cathodic protection of ships' hulls and other metal structures.

Dimensionally stable electrodes generally comprise a valve metal base such as Ti, Ta, Zr, Hf, Nb and W, which under anodic polarization develop a corrosion-resistant but non-electrically conductive oxide layer or "barrier layer", coated over at least a portion of their outer surface with an electrically conductive and electrocatalytic layer of platinum group metal oxides or platinum group metals (see U.S. Pat. No. 3,711,385, No. 3,632,498 and No. 3,846,273. Electroconductive and electrocatalytic coatings made of or containing platinum group metals or platinum group metal oxides are, however, expensive and are eventually subjected to consumption or deactivation in certain electrolytic processes and, therefore, reactivation or recoating is necessary to reactivate exhausted electrodes.

Furthermore, electrodes of this type are not operable in a number of electrolytic processes. For example, in molten salt electrolytes, the valve metal support is rapidly dissolved, since the thin protective oxide layer is either not formed at all or is rapidly destroyed by the molten electrolyte with the consequent dissolution of the valve metal base and loss of the catalytic noble metal coating. Moreover, in several aqueous electrolytes, such as fluoride solutions or in sea-water, the breakdown voltage of the protective oxide layer on the exposed valve metal base is too low and the valve metal base is often corroded under anodic polarization.

Recently, other types of electrodes have been suggested to replace the rapidly consumed carbon anodes and carbon cathodes used up to now in severely corrosive applications such as the electrolysis of molten metal salts, typically for the electrolysis of molten fluoride baths such as those used to produce aluminum from molten cryolite. In this particular electrolytic process which is of great economic importance, carbon anodes are consumed at a rate of approximately 450 to 500 kg of carbon per ton of aluminum produced and expensive constant adjustment apparatus is needed to maintain a small and uniform gap between the corroding anode surfaces and the liquid aluminum cathode. It is estimated that over 6 million tons of carbon anodes are consumed in one year by aluminum producers. The carbon anodes are burned away according to the reaction:

$$Al_2O_3+3/2C \rightarrow 2Al+3/2CO_2$$

but the actual consumption rate is much higher due to fragilization and breaking away of carbon particles and to intermittent sparking which takes place across anodic gas films which often form over areas of the anode surface since carbon is poorly wetted by the molten salts electrolytes, or to short circuiting caused by "bridges" of conductive particles coming from the corroding carbon anodes and from dispersed particles of the depositing metal.

British Patent No. 1,295,117 discloses anodes for molten cryolite baths consisting of a sintered ceramic oxide material consisting substantially of $SnO_2$ with minor amounts of other metal oxides, namely, oxides of Fe, Sb, Cr, Nb, Zn, W, Zr, Ta in concentration of up to 20%. While electrically conducting sintered $SnO_2$ with minor additions of other metal oxides, such as oxides of Sb, Bi, Cu, U, Zn, Ta, As, etc., has been used for a long time as a durable electrode material in alternating current glass smelting furnaces (see U.S. Pat. Nos. 2,490,825, 2,490,826, 3,287,284 and 3,502,597), it shows considerable wear and corrosion when used as an anode material in the electrolysis of molten salts. We have found wear rates of up to 0.5 grams per hour per $cm^2$ from samples of the compositions described in the patents mentioned above when operated in fused cryolite electrolyte at 3000 $A/m^2$. The high wear rate of sintered $SnO_2$ electrodes is thought to be due to several factors: (a) chemical attack by the halogens, in fact $Sn^{IV}$ gives complexes of high coordination numbers with halogen ions; (b) reduction of $SnO_2$ by aluminum dispersed in the electrolyte; and (c) mechanical erosion by anodic gas evolution and salt precipitation within the pores of the material.

Japanese Patent Application No. 112589 (Publication No. 62,114 of 1975) discloses electrodes having a conductive support of titanium, nickel or copper or an alloy thereof, carbon graphite or other conductive material coated with a layer consisting substantially of spinel and/or perovskite type metal oxides and alternatively electrodes obtained by sintering mixtures of said oxides. Spinel oxides and perovskite oxides belong to a family of metal oxides which typically show good electronic conductivity and have been proposed previously as suitable electroconductive and electrocatalytic anodic coating materials for dimensionally stable valve metal anodes (see U.S. Pat. Nos. 3,711,382 and 3,711,297; Belgian Patent No. 780,303).

Coatings of particulate spinels and/or perovskites have been found, however, to be mechanically weak as the bonding between the particulate ceramic coating and the metal or carbon substrate is inherently weak, because the crystal structure of the spinels and of the perovskites are not isomorphous with the oxides of the metal support and various binding agents such as oxides, carbides, nitrides and borides have been tried with little or no improvement. In molten salt electrolytes, the substrate material is rapidly attacked due to the inevitable pores through the spinel oxide coating and the coating is quickly spalled off the corroding substrate. Furthermore, spinels and perovskites are not chemically or electrochemically stable in molten halide salt electrolytes and show an appreciable wear rate due to halide ion attack and to the reducing action of dispersed metal.

In the electrolytic production of metals from molten halide salts, the mentioned anodes of the prior art have been found to have another disadvantage. The appreciable dissolution of the ceramic oxide material brings metal cations into the solution which deposit on the cathode together with the metal which is being produced and the impurity content in the recovered metal is so high that the metal can no longer be used for applications requiring electrolytic grade purity. In such cases, the economic advantages of the electrolytic process which are due, to a large extent, to the high purity attainable compared to the smelting processes are partially or entirely lost.

An electrode material to be used successfully in severly corrosive conditions such as in the electrolysis of molten halide salts and particularly of molten fluroide salts, should primarily be chemically and electrochemically stable at the operating conditions. It should also be catalytic with respect to the anodic evolution of oxygen and/or halides, so that the anode overpotential is lowest for high overall efficiency of the electrolysis process. The electrode should also have the thermal stability at operating temperatures of, i.e., about 200° to 1100° C., good electrical conductivity and be sufficiently resistant to accidental contact with the molten metal cathode. Excluding coated metal electrodes, since hardly any metal substrate could resist the extremely corrosive conditions found in molten fluoride salt electrolysis, we have systematically tested the performances of a very large number of sintered substantially ceramic electrodes of different compositions.

THE INVENTION

The novel method of the invention for the electrolysis of a molten salt comprises passing a direct current through a molten metal salt between an anode and a cathode wherein a gas is usually formed at the anode and the [molten] metal is produced at the cathode, the anode being comprised of a self-sustaining matrix of sintered powders of at least one oxycompound such as oxides, multipleoxides, mixed oxides, oxyhalides and oxycarbides, of at least one metal selected from the group consisting of lanthanum, terbium, erbium, ytterbium, chromium, thorium, titanium, zirconium, hafnium, niobium and tantalum and at least one electroconductive agent, the said anode being provided over at least a portion of its surface with at least one electrocatalyst.

The "sintered" electrode is meant to describe a self-sustaining, essentially rigid body consisting principally of an oxy metal compound and at least one electroconductive agent produced by any of the known methods used in the ceramic industry such as by the application of temperature and presence to a powdered mixture of the materials to shape the mixture to the desired size and shape, or by casting the material in molds, by extrusion, or by the use of bonding agents and so forth, and then sintering the shaped body at high temperature into a self-sustaining electrode. The oxyhalides compounds are preferably the oxychlorides or oxyfluorides.

The electrical conductivity of the sintered ceramic electrodes [are] is improved by adding to the composition 0.1 to 20% by weight of at least one electroconductive agent selected from the group consisting of (A) doping oxides, typically of metals having a valence which is lower or higher than the valence of the metals of the oxides constituting the matrix, such as the alkaline earth metals [oxides of] Ca, Mg, Sr and Ba and metals such as Zn, Cd, $In_2$, $Tl_2$, $As_2$, $Sb_2$, $Bi_2$ and Sn; (B) oxides showing electroconductivity due to intrinsic Redox systems such as spinel oxides, perovskites oxides etc.; (C) oxides showing electroconductivity due to metal to metal bonds such as $CrO_2$, $MnO_2$, TiO, $Ti_2O_3$ etc.; borides, silicides, carbides and sulfides of the valve metals such as Ti, Zr, Hf, V, Nb, Ta, Cr, Mo and W or the metals Y, Ti, Zr, Hf, V, Nb, Ta, Cr, Mo, W, Pd and Ag or alloys thereof or mixtures of (A) and/or (B) and/or (C).

The preferred electro[conductive]catalysts are selected from the group of metals consisting of ruthenium, rhodium, palladium, iridium, platinum, iron, cobalt, nickel, copper and silver and mixtures thereof and oxides of metals of the group consisting of manganese, iron, cobalt, nickel, ruthenium, rhodium, palladium, iridium, platinum, silver, arsenic, antimony lead and bismuth and mixtures thereof.

By admixing with the powder of the matrix material, a minor amount, typically from 0.5 to about 30%, of powders of a suitable electrocatalytic material and by sintering the mixture into a self-sustaining body, it shows, when used as an electrode, satisfactory electroconductive and electrocatalytic properties which retains its chemical stability even though the admixed catalyst would not be resistant per se to the conditions of the electrolysis.

The electrocatalyst may be a metal or an inorganic oxycompound. The preferred admixed catalyst powders are the powdered metals Ru, Rh, Pd, Ir, Pt, Fe, Co, Ni, Cu and Ag, especially the platinum group metals; powdered oxycompounds of Mn, Fe, Co, Ni, Ru, Rh, Pd, Ir, Pt, Ag, As, Sb and Bi and especially oxycompounds of the platinum group metals.

Specifically preferred are $\beta MnO_2$, $Co_3O_4$, $Rh_2O_3$, $IrO_2$, $RhO_2$, $Ag_2O$, $Ag_2O_2$, $Ag_2O_3$, $As_2O_3$, $Sb_2O_3$, $Bi_2O_3$, $CoMn_2O_4$, $NiMn_2O_4$, $CoRh_2O_4$ and $NiCo_2O_4$ and mixtures of said powdered metals and oxycompounds.

It has been found to be especially advantageous to add to the oxymetal compound a second material such as stannous oxide, zirconium oxide or the like and that also by adding a small amount of at least one metal belonging to the group comprising yttrium, chromium, molybdenum, zirconium, tantalum, tungsten, cobalt, nickel, palladium and silver, both the mechanical properties and the electrical conductivity of the sintered electrodes are improved without appreciably decreasing their chemical and electrochemical corrosion resistance.

These additives are added in powder form and mixed with the powdered metal oxide in percentages which may range from 40 to 1% calculated in terms of weight of the metal content. Optionally, yet other organic and/or inorganic compounds may be added to the powder mixture to improve on the bonding of the particles during both the moulding and sintering processes.

The anodes have a high melting point well above the temperature of the molten salt electrolytes being used and they undergo no phase change under working conditions of the electrolysis. Moreover, the thermal elongation co-efficient is not far different from that of the halide salts used in the molten salts bath, which helps preserve the proper electrode spacing between the anode and the cathode and avoids expansions and contractions which might break the salt crust on the top of the molten salt electrolyte in the normal aluminum electrowinning process.

The conductivity of the sintered electrodes of the invention is comparable with that of graphite. The matrix has acceptable work-ability in the forming and sintering operation and in use forms a thin layer of oxyhalides on its surface under anodic conditions. The metal oxycompounds free formation energy is more negative than the oxide free formation energy of the corresponding halide-phase fused salt electrolyte, so that these sintered anodes have a high degree of chemical stability.

The sintered metal oxycompound electrodes of the invention may also be used as bipolar electrodes. According to this latter embodiment, the sintered electrodes may be conventiently produced in the form of a slab or plate whereby one of the two major surfaces of the electrode is provided with a layer containing the anodic electrocatalyst such as the oxides $CO_3O_4$, $Ni_3O_4$, $MnO_2$, $Rh_2O_3$, $IrO_2$, $RuO_2$, $Ag_2O$ etc. and the other major surface is provided with a layer containing suitable cathodic materials such as carbides, borides, nitrides, sulfides, carbonitrides etc. of metals, particularly of the valve metals and most preferably of yttrium, titanium and zirconium.

The self-sustaining sintered body consisting of a major portion of oxymetal compound may be prepared by grinding the materials together, or separately, preferably to a grain size between 50 and 500 microns, to provide a powder mixture which contains a range of grain sizes to obtain a better degree of compaction. According to one of the preferred methods, the mixture of powders is mixed with water or with an organic binding agent to obtain a plastic mass having suitable flowing properties for the particular forming process used. The material may be molded in known manner either by ramming or pressing the mixture in a mold or by slip-casting in a plaster of Paris mold or the material may be extruded through a die into various shapes.

The molded electrodes are then subjected to a drying process and heated at a temperature at which the desired bonding can take place, usually between 800° to 1800° C. for a period of between 1 to 30 hours, normally followed by slow cooling to room temperature. The heat treatment is preferably carried out in an inert atmosphere or one that is slightly reducing, for example in $H_2+N_2$ (80%), when the powdered mixture is composed essentially of oxymetal compound with a minor portion of other metal oxides or metals.

When the powdered mixture contains also metallic powders, it is preferable to carry out the heat treatment in an oxidizing atmosphere, at least for a portion of the heat treatment cycle to promote the oxidation of metallic particles in the outside layers of the electrodes. The metallic particles remaining inside the body of the sintered material improve the electrical conductivity properties of the electrode.

The forming process may be followed by the sintering process at a high temperature as mentioned above or the forming process and the sintering process may be simultaneous, that is, pressure and temperature may be applied simultaneously to the powder mixture, for example by means of electrically-heated molds. Lead-in connectors may be fused into the ceramic electrodes during the molding and sintering process or attached to the electrodes after sintering or molding. Other methods of shaping, compressing and sintering the powder mixture may of course be used.

The electrocatalyst, usually applied to the electrode surface due to costs, should have a high stability, a low anodic overpotential for the wanted anodic reaction, and a high anodic overpotential for non-wanted reactions. In the case of chlorine evolution, oxides of cobalt, nickel, iridium, rhodium, ruthenium or mixed oxides thereof such as $RuO_2$—$TiO_2$ etc. can be used, and in the case of fluoride containing electrolytes wherein oxygen evolution is the wanted anodic reaction, oxides of silver and manganese are preferable. Other oxides for use as electrocatalysts may be oxides of platinum, palladium and lead.

Poisons for the suppression of unwanted anodic reaction may be used, such as, for example, to suppress oxygen evolution from chloride electrolytes. Poisons which present a high oxygen overpotential should be used and suitable materials are the oxides of arsenic, antimony and bismuth. These oxides which are used in small percentages may be applied together with the electrocatalyst oxides in percentage of 1 to 10% of the electrocatalyst calculated in terms of the respective metals weight.

The application of the electrocatalyst, and optionally of the poisoning agent may be effected by any of known coating methods. Preferably the electrocatalyst, and optionally the poisoning agent, are applied to the sintered electrodes as a solution of decomposible salts of the metals. The sintered body is impregnated with the solution containing the appropriate metal salts and dried. Hence the electrode is heated in air or in otherwise oxygen containing atmosphere to convert the salts into the wanted oxides.

Usually the porosity of the sintered body and the method used to impregnate the surface layers of the sintered body with the metal salts should provide for the pentration of the solution down to a depth of at least 1 to 5 millimeters, preferably 3 mm, inward from the surface of the electrode so that after the heat treatment the electrocatalysts are present in the pores of the sintered body down to a certain depth inward from the surface of the electrodes.

Alternatively, by appropriate powder mixing techniques, preformed electrocatalyst oxides and optionally preformed poisoning oxides, may be ground into powder form and added to the powder mixture during the moulding of the electrodes in such a way that the external layers of the moulded electrodes are enriched with powders of the electrocatalyst oxides, and optionally of the poisoning oxides, during the forming process whereby after sintering the surface of the electrodes is already provided with the electrocatalyst.

The sintered electrodes of the invention may be used as bipolar electrodes. According to this embodiment of the invention, electrodes may be provided over one surface with the anodic electrocatalyst, and optionally with the poisoning agent for the unwanted anodic reaction by one of the methods disclosed above while the other surface may be provided with a coating of suitable cathodic material. For example, the surface of the bipolar electrode which will function as a cathode during the process of electrolysis may be provided with a layer of metal carbides, borides, nitrides, sulfides and/or carbonitrides of yttrium, tantalum, titanium, zirconium etc.

One preferred method to apply a layer is by plasma-jet technique whereby powders of the selected materials are sprayed and adhere to the surface of the sintered body with a flame under controlled atmosphere. Alternatively, the selected powdered material may be added during the forming process to the powder mixture and thence be sintered together whereby the cathodic surface of the bipolar electrode is provided with a layer of the selected cathodic material.

The electrodes may be used effectively for the electrolysis of many electrolytes. They are especially advantageous when used as anodes in electrolytic cells used for electrolyzing molten salt electrolytes such as molten cryolite baths, molten halides of aluminum, magnesium, sodium, potassium, calcium, lithium and other metals. Thus, aluminum halides may be electrolyzed according to the Hall process or processes disclosed in U.S. Pat. Nos. 3,464,900, 3,518,712, or 3,755,099 (the disclosure of which is incorporated herein by reference) using the electrodes herein described as anodes. The temperature of electrolysis is high enough to melt and maintain the salts of the metal to be recovered in a molten state and the metal is deposited in the molten state and usually collected as a molten cathode with molten metal being withdrawn from the molten cathode.

The electrodes may also be used effectively as anodes and/or cathodes in direct current electrolysis of other molten salt electrolytes typically containing halides, oxides, carbonates or hydrates for the production of aluminum, beryllium, calcium, cerium, lithium, sodium, magnesium, potassium, barium, strontium, cesium and other metals.

When the electrodes of the invention are used as bipolar electrodes for molten salt electrolysis, the composition of the cathode portion of the electrodes must be such that it will not be reduced by the cathodic reaction or attacked by the metal being deposited at the cathodes, particularly when the electrode composition is an oxycompound. For this reason, it is desirable to have the compositio of the cathode side of the bipolar electrode inert to the cathodic reaction and the reducing action of the molten metal.

In the accompanying drawing which is a schematic cross-section of a horizontal electrolysis cell suitable for the production of aluminum, the cathodic portion of the cell comprises a steel cradle 1 lined with carbon 2 in which steel cathode collector bars 3 are embedded which, in turn, are connected to the riser bus 4 leading to the next cell of the series and to the cathode ring bus 5 from a preceding cell. The base is provided with alumina insulation 6 between the cradle 1 and the carbon lining 2. The anodic portion comprises the sintered ceramic electrodes 10 mounted above the cathodic base and provided with electrical connections 11 to a suitable source of direct current. A cryolite electrolyte 9, to which alumina is fed during the electrolysis, is provided in the pot formed by the carbon lining 2. The cell is provided with a hood 12 for air control and a slag crust 13 consisting of solidified cryolite and alumina covers the molten electrolyte, and alumina ore bin 14 for periodically adding additional alumina is provided and means (not shown) for removing the molten aluminum is provided. On application of direct current, liquid aluminum 8 separates on the bottom of the pot formed by the carbon lining 2.

The cell construction is suitable for electrolysis of molten metal salts wherein the metal formed is heavier than the electrolyte and will, therefore, form the molten cathode on the base of the cell. For electrolysis processes wherein the molten metal salt has a higher specific gravity than the metal formed, a vertical cell is preferably used. Molten salt baths for such vertical cells are cryolite having a greater than normal amount of barium carbonate or molten salts of lighter metals, such as sodium.

In a vertical cell of this type, the ceramic electrode of the invention is used as a vertical anode in the molten salt bath and a vertical cathode made of a suitable material such as a valve metal boride is used to form a bipolar electrode and the electrolysis current is passed therethrough. Alternatively, the material resistant to cathodic conditions such as yttrium, titanium or zirconium borides, may be incorporated in the sintered bipolar electrode on the cathode side thereof. The molten metal is formed at the vertical cathode and the metal rises to the top of the molten salt bath where it is then removed. If the molten salt is a halide, halogen is formed at the anode and is recovered.

In the following examples there are describes several preferred embodiments to illustrate the invention. However, it should be understood that the invention is not intended to be limited to the specific embodiments. The percentages of the components of the electrodes are calculated in percent by weight and calculated as free metal based on the total metal content of the composition.

EXAMPLE 1

About 250 g of a mixture of the matrix material and additive materials indicated in Table I were ground in a mixer for 20 minutes and the powder mixtures were poured into cylindrical plastic molds and pre-compressed manually with a steel cylinder press. Each mold was placed in an isostatic pressure chamber and the pressure was raised to about 1500 Kg/cm$^2$ in 5 minutes and then reduced to zero in a few seconds. The samples were then taken out of the plastic molds and polished. The pressed samples were put into an electrically heated furnace and heated from room temperature to 1200° C. under a nitrogen atmosphere over a period of 24 hours, held at the maximum temperature for 2 to 5 hours and then cooled to 300° C. over the following 24 hours. The sintered samples were then taken out of the furnace and after cooling to room temperature, they were weighed and their apparent density and electrical conductivity at 25° C. and at 1000° C. were measured. The results are reported in Table I.

| Sample No. | Sample composition and percentage by weight | | Sintering time at max. temp. (hrs.) | Apparent density gr/cm$^3$ | Electrical conductivity at 1000° $\Omega^{-1}$ cm$^{-1}$ | Electrical conductivity at 25° C. $\Omega^{-1}$ cm$^{-1}$ |
|---|---|---|---|---|---|---|
| 1 | $ZrO_2$ | 60% | | | | |
| | $Y_2O_3$ | 10% | 5 | 5.1 | 0.1 | — |
| | YOF | 10% | | | | |
| | $IrO_2$ | 20% | | | | |
| 2 | $Ta_2O_5$ | 50% | | | | |
| | $La_2O_3$ | 5% | | | | |
| | $SiO_2$ | 5% | 5 | 5.3 | 0.4 | — |
| | $VO_2$ | 20% | | | | |

-continued

| Sample No. | Sample composition and percentage by weight | | Sintering time at max. temp. (hrs.) | Apparent density gr/cm$^3$ | Electrical conductivity at 1000° $\Omega^{-1}$ cm$^{-1}$ | Electrical conductivity at 25° C. $\Omega^{-1}$ cm$^{-1}$ |
|---|---|---|---|---|---|---|
| | $Co_3O_4$ | 20% | | | | |
| 3 | $ZrO_2$ | 50% | | | | |
| | $Ti_2O_3$ | 20% | 5 | 5.1 | 0.3 | — |
| | $ZrOCl_2$ | 20% | | | | |
| | $Rh_2O_3$ | 10% | | | | |
| 4 | $Nb_2O_5$ | 30% | | | | |
| | $TiO_2$ | 20% | | | | |
| | YOF | 20% | 5 | 5.6 | 0.5 | — |
| | $Ag_2O$ | 20% | | | | |
| | $Sb_2O_3$ | 10% | | | | |
| 5 | $Y_2O_3$ | 20% | | | | |
| | $La_2O_3$ | 20% | | | | |
| | $ThO_2$ | 20% | 5 | 5.8 | 0.7 | — |
| | $Ti_2O_3$ | 20% | | | | |
| | $Rh_2O_3$ | 20% | | | | |
| 6 | $ZrO_2$ | 40% | | | | |
| | $Y_2O_3$ | 5% | | | | |
| | $SiO_2$ | 5% | | | | |
| | $Zr_2OCl_2$ | 15% | 5 | 5.3 | 1.2 | — |
| | $Bi_2O_3$ | 10% | | | | |
| | $Ag_2O$ | 15% | | | | |
| | $RuO_2$ | 5% | | | | |
| | CuO | 5% | | | | |
| 7 | $ZrO_2$ | 50% | | | | |
| | $Y_2O_3$ | 30% | | | | |
| | $SnO_2$ | 10% | 5 | 5.9 | 1.0 | — |
| | $IrO_2$ | 8% | | | | |
| | CuO | 2% | | | | |
| 8 | $ZrO_2$ | 30% | | | | |
| | $Yb_2O_3$ | 10% | | | | |
| | $ThO_2$ | 10% | 5 | 5.8 | 0.8 | — |
| | $Ti_2O_3$ | 25% | | | | |
| | $SnO_2$ | 15% | | | | |
| | $Co_3O_4$ | 10% | | | | |
| 9 | $TiO_2$ | 20% | | | | |
| | $Al_2O_3$ | 20% | | | | |
| | $Ti_2O_3$ | 20% | 5 | 5.4 | 2.1 | — |
| | $SnO_2$ | 20% | | | | |
| | $\beta MnO_2$ | 20% | | | | |
| 10 | $ZrO_2$ | 30% | | | | |
| | $Y_2O_3$ | 5% | | | | |
| | YOF | 25% | 2 | 5.1 | 4 | 0.5 |
| | Y | 20% | | | | |
| | $RuO_2$ | 20% | | | | |
| 11 | $TiO_2$ | 20% | | | | |
| | $Ta_2O_5$ | 30% | | | | |
| | $VO_2$ | 10% | 2 | 5.7 | 5 | 0.9 |
| | $Fe_2O_3$ | 10% | | | | |
| | $Co_3O_4$ | 10% | | | | |
| | Co | 20% | | | | |
| 12 | $TiO_2$ | 40% | | | | |
| | TiOC | 25% | | | | |
| | $SnO_2$ | 15% | 5 | 6.3 | 12 | 1.6 |
| | $RuO_2$ | 5% | | | | |
| | Mo | 10% | | | | |
| | Ti | 5% | | | | |
| 13 | $TiO_2$ | 40% | | | | |
| | $Ta_2O_5$ | 10% | | | | |
| | $Ti_2O_3$ | 10% | 5 | 6.1 | 10 | 2.5 |
| | $Co_3O_4$ | 20% | | | | |
| | Mo | 10% | | | | |
| | $As_2O_3$ | 10% | | | | |
| 14 | $ZrO_2$ | 40% | | | | |
| | $Y_2O_3$ | 5% | | | | |
| | $VO_2$ | 25% | 2 | 6.5 | 15 | 2.5 |
| | AgO | 20% | | | | |
| | Pd | 1% | | | | |
| | Mo | 9% | | | | |

The data in Table I shows that the electrical conductivity of the sintered ceramic electrodes at high temperatures of 1000° C. is 5 to 10 times higher than the electrical conductivity at 25° C. The addition of oxides having conductivity equivalent to metals to the substantially non-conductive ceramic oxides of the matrix increases the conductivity of the electrodes by a magnitude of $10^2$. The addition of a metal stable to molten salts such as yttrium or molybdenum, etc. to the ceramic electrodes of the invention increases the electrical conductivity of the electrodes by 2 to 5 times.

EXAMPLE 2

The conditions of operation of an electrolysis cell for the production of aluminum metal from a molten cryolite bath were simulated in a laboratory test cell. In a heated crucible of graphite, a layer of liquid aluminum was provided on the bottom and a melt consisting of cryolite (80 to 85%), alumina (5 to 10%) and $AlF_3$ (from 1 to 5%) was poured on top thereof. The sample electrodes with a working surface area of 3 $cm^2$ prepared according to the procedure described in Example 1 and to which a Pt wire was brazed to provide an easy means for electrical connection were dipped into the salt melt and held at a distance of about 1 cm from the liquid aluminum layer. The crucible was maintained at a temperature ranging from 950° to 1050° C. and the current density was 0.5 $A/cm^2$ and the cell was operated for 2000 hours. The experimental data obtained is shown in Table II. The sample number indicates that the electrode tested corresponds to the sample described in Table I with the same number.

TABLE II

| Sample No. | Aluminum produced (g/h) | Weight loss of anodes ($g/cm^2$) |
|---|---|---|
| | 0.49 | 0.02 |
| 2 | 0.50 | 0.12 |
| 3 | 0.49 | 0.04 |
| 4 | 0.49 | 0.02 |
| 5 | 0.48 | 0.01 |
| 6 | 0.49 | 0.04 |
| 7 | 0.49 | 0.06 |
| 8 | 0.46 | 0.18 |
| 9 | 0.46 | 0.2 |

The test sample electrodes operated successfully as anodes in the cryolite melt and the observed wear rates appear to be quite acceptable for the electrolytic production of aluminum from molten cryolite. All the tested electrodes showed a low wear rate during 2000 hours of operation. In general, the wear rate of the electrodes containing thermal stablilizers such as oxycompounds of metals of Group III of the Periodic Table is about 10 times less than the electrodes without thermal stabilizers.

EXAMPLE 3

Electrodes Nos. 4 and 5 described in Table I were used as anodes for the electrolysis of a molten aluminum chloride electrolyte in the test cell described in Example 2. The electrolysis conditions were the following:

| | | |
|---|---|---|
| Electrolyte | $AlCl_3$ | from 31 to 35% b.w.t. |
| | NaCl | from 31 to 35% b.w.t. |
| | $BaCO_3$ | from 31 to 35% b.w.t. |
| Temperature of Electrolyte | | from 690° to 720° C. |
| Anodic current density | | 2000 $Amp/m^2$ |
| Cathode | Molten Aluminum | |
| Interelectrodic gap | 1 cm. | |

The tested electrodes operated successfully and the weight losses after 2000 hours of operation were negligible.

Other electrocatalysts which may be used in the electrolysis of molten halide salts for halide ion discharge are $RuO_2$ and oxides such as $As_2O_3$, $Sn_2O_3$ and $Bi_2O_3$ may be added in percentages up to 10% by weight of free metal based upon the total metal content to rise the oxygen overpotential without affecting the halide ion discharge potential.

For anodes to be used in molten fluoride electrolytes where oxygen is evolved, the catalyst may be those listed in Example V or $Rh_2O_3$, $PbO_2$ and $IrO_2.TiO_2$.

The components of the anodes given in the Examples are calculated in percent by weight of free metal based upon the total metal content of the anode composition.

The electrolyte may contain other salts than those used in the Examples such as alkali metal chloride or fluoride as well as the salt of the metal undergoing electrolysis. The metal halides are effective to reduce the melting point of the salt undergoing electrolysis thus permitting use of lower temperatures while maintaining the salt bath in molten or melted state.

The above examples include fused or molten metal salt electrolysis, primarily the electrolysis of molten aluminum chloride or fluoride salts. In a similar manner, the molten chlorides of other metals such as alkali metal or alkaline earth metals may be electrolyzed using the designated anodes, according to otherwise standard practice. In addition, other molten salts, such as the molten nitrates, may be electrolyzed in the same way. A molten alumina-cryolite electrolyte or the like alkali metal aluminum fluoride may be electrolyzed to produced molten aluminum.

These electrodes may be used in place of graphite anodes in standard aluminum electrowinning cells with either aluminum ore feed into a cryolite bath or with aluminum chloride feed into a predominately aluminum chloride bath.

The use of these sintered metal oxide anodes for the recovery of the desired metals from fused salts of the metals to be won results in reduced power consumption per unit weight of metal produced and in purer recovered metals. The electrodes are dimensionally stable in service and therefore do not require frequent interventions to restore the optimum distance from the cathode surface as it is necessary with the consumable anodes of the prior art.

Various modifications of the electrodes and processes of the invention may be made without departing from the spirit or scope of our invention and it is to be understood that the invention is intended to be limited only as defined in the appended claims.

We claim:

1. In a method of molten salt electrolysis between an anode and a cathode wherein the salt is selected from the group consisting of metal halides and cryolite, the improvement comprising using as the anode and electrode comprised of a self-sustaining matrix of sintered powders of at least one oxycompound of at least one metal selected from the group consisting of lanthanum, terbium, erbium, ytterbium, thorium, titanium, zirconium, hafnium, chromium, niobium and tantalum and at least one electroconductive agent, the said anode being provided over at least a portion of its surface with at least one electrocatalyst.

2. The method of claim 1 wherein the electroconductive agent is a minor portion of the sintered electrode body and is an oxide of at least one metal selected from the group consisting of zirconium and tin.

3. The method of claim 1 wherein the electroconductive agent is a minor portion of the sintered electrode body and is at least one metal selected from the group consisting of yttrium, chromium, molybdenum, zirconium, tantalum, tungsten, cobalt, nickel, palladium and silver.

4. The method of claim 1 wherein the electrocatalyst is at least one member selected from the group consisting of oxides of cobalt, nickel, manganese, rhodium, iridium, ruthenium and silver.

5. The method of claim 1 wherein the electrocatalyst is formed in situ on said sintered electrode body from a solution of salts of said metals which are converted to oxides on said sintered electrode body.

6. The method of claim 4 in which the electrocatalyst is comprised of powdered oxides of said metals sintered into the outer layers of said electrode.

7. The method of claim 1 wherein the molten metal salt is a metal chloride.

8. The method of claim 1 wherein the metal salt is aluminum chloride, and gaseous chlorine is evolved at the anode.

9. The method of claim 1 wherein the metal salt is fluoride.

10. The method of claim 9 wherein the metal salt is cryolite containing molten alumina.

11. In an electrolytic cell for molten salt electrolysis comprising at least one anode and one cathode and means for imposing a direct current between the anode and cathode, the improvement wherein the anode is an electrode comprised of a self-sustaining matrix of sintered powders of at least one oxycompound of at least one metal selected from the group consisting of lanthanum, terbium, erbium, ytterbium, thorium, titanium, zirconium, hafnium, chromium, niobium and tantalum and at least one electroconductive agent the said anode being provided over at least a portion of its surface with at least one electrocatalyst and said cathode having over at least a portion of its cathodic surface a layer of cathodic material selected from the group consisting of metal carbides, borides, nitrides, sulfides and carbonitrides and mixtures thereof.

12. The cell of claim 11 wherein the electroconductive agent is a minor portion of the sintered electrode body and is an oxide of at least one metal selected from the group consisting of zirconium and tin.

13. The cell of claim 11 wherein the electroconductive agent is a minor portion of the sintered electrode body and is at least one metal selected from the group consisting of yttrium, chromium, molybdenum, zirconium, tantalum, tungsten, cobalt, nickel, palladium and silver.

14. The cell of claim 11 wherein the electrocatalyst is at least one member selected from the group consisting of oxides of cobalt, nickel, manganese, rhodium, iridium, ruthenium and silver.

15. The cell of claim 14 wherein the electrocatalyst is formed in situ on said sintered electrode body from a solution of salts of said metals which are converted to oxides on said sintered electrode body.

16. The cell of claim 14 in which the electrocatalyst is comprised of powdered oxides of said metals sintered into the outer layers of said electrode.

17. The cell of claim 11 containing at least one bipolar electrode comprising a self-sustaining body of sintered powders of at least one oxycompound of at least one metal selected from the group consisting of lanthanum, terbium, erbium, ytterbium, thorium, titanium, zirconium, hafnium, chromium, niobium and tantalum and at least one electroconductive agent, said electrode being provided over at least a portion of its anodic surface with at least one anodic electrocatalyst and over at least a portion of its cathodic surface with a layer of cathodic material selected from the group consisting of metal carbides, borides, nitrides, sulfides and carbonitrides and mixtures thereof.

18. The cell of claim 17 wherein the electroconductive agent is a minor portion of the sintered electrode body and is an oxide of at least one metal selected from the group consisting of zirconium and tin.

19. The cell of claim 17 wherein the electroconductive agent is a minor portion of the sintered electrode body and is at least one metal selected from the group consisting of yttrium, chromium, molybdenum, zirconium, tantalum, tungsten, cobalt, nickel, palladium and silver.

20. The cell of claim 17 wherein the electrocatalyst is selected from the group consisting of oxides of cobalt, nickel, manganese, rhodium, iridium, ruthenium, silver and mixtures thereof.

21. The cell of claim 17 wherein the electrocatalyst is formed in situ on said sintered electrode body from a solution of salts of said metals which are converted to oxides on said sintered electrode body.

22. The cell of claim 17 in which the electrocatalyst is comprised of powdered oxides of said metals sintered into the outer layers of said electrode.

23. The cell of claim 17 wherein the layer of the said cathodic material is applied by flame spraying.

24. The cell of claim 17 wherein the layer of the said cathodic material comprises powders of said cathodic material sintered into the outer cathodic surfaces of said electrode.

25. The cell of claim 17 wherein the cathodic material is selected from the group comprising carbides, borides, nitrides, sulfides and carbonitrides of at least one metal selected from the group comprising yttrium, titanium and zirconium.

* * * * *